US008926825B2

(12) United States Patent
Cullen

(10) Patent No.: US 8,926,825 B2
(45) Date of Patent: Jan. 6, 2015

(54) PROCESS FOR REMOVING SULFUR FROM HYDROCARBON STREAMS USING HYDROTREATMENT, FRACTIONATION AND OXIDATION

(76) Inventor: Mark Cullen, Reno, NV (US)

( * ) Notice: Subject to any disclaimer, the term of this patent is extended or adjusted under 35 U.S.C. 154(b) by 236 days.

(21) Appl. No.: 13/050,698

(22) Filed: Mar. 17, 2011

(65) Prior Publication Data

US 2011/0226670 A1 Sep. 22, 2011

Related U.S. Application Data

(60) Provisional application No. 61/315,737, filed on Mar. 19, 2010.

(51) Int. Cl.
*C10G 67/02* (2006.01)
*C10G 67/12* (2006.01)

(Continued)

(52) U.S. Cl.
CPC ..... *C10G 67/12* (2013.01); *C10G 27/12* (2013.01); *C10G 31/06* (2013.01); *C10G 45/02* (2013.01); *C10G 67/04* (2013.01); *C10G 67/06* (2013.01); *C10G 67/14* (2013.01); *C10L 1/08* (2013.01); *C10G 53/14* (2013.01); *C10G 2300/1055* (2013.01); *C10G 2300/202* (2013.01); *C10G 2300/207* (2013.01); *C10G 2400/04* (2013.01)
USPC ..... 208/49; 208/208 R; 208/209; 208/212

(58) Field of Classification Search
CPC ..... C10G 2300/1055; C10G 2300/202; C10G 2300/207; C10G 2400/04; C10G 27/12; C10G 31/06; C10G 45/02; C10G 53/14; C10G 67/04; C10G 67/06; C10G 67/12; C10G 67/14
USPC ..... 208/208 R, 209, 212, 213, 216 R, 217, 208/218, 222, 347, 349, 49
See application file for complete search history.

(56) References Cited

U.S. PATENT DOCUMENTS 2,253,308 A 8/1941 Rosen
2,671,049 A 3/1954 Brown (Continued)

FOREIGN PATENT DOCUMENTS

EP 0482841 10/1999
WO 00/15734 1/2000
WO 02/103322 12/2002

OTHER PUBLICATIONS

Chemspider/www.chemspider.com/Chemical-Structure. 1064783(4,6 dimethyldibenzothiophene).*

(Continued)

*Primary Examiner* — Walter D Griffin
*Assistant Examiner* — Derek Mueller
(74) *Attorney, Agent, or Firm* — Stetina Brunda Garred & Brucker

(57) ABSTRACT

Methods for removing sulfur from hydrocarbon streams using the sequential application of hydrodesulfurization, fractionation and oxidation. The hydrodesulfurization step is operative to remove easily-hydrogenated sulfur species, such as sulfides, disulfides and mercaptans. The resultant stream is then fractionated at a select temperature range to generate a sub-stream that is sulfur-rich with the sulfur species resistant to removal by hydrodesulfurization. The sub-stream is then isolated and subjected to an oxidative process operative to oxidize the sulfur species to sulfones or sulfoxides, which may then be removed by a variety of conventional methods, such as absorption. Alternatively, the methods may comprise using the sequential application of fractionation to generate a sulfur-rich sub-stream followed by oxidation and subsequent removal of the sulfur species present in the sub-fraction. The latter methods are ideally suited for transmix applications.

10 Claims, 2 Drawing Sheets

(51) Int. Cl.

| | |
|---|---|
| ***C10G 27/12*** | (2006.01) |
| ***C10G 31/06*** | (2006.01) |
| ***C10G 45/02*** | (2006.01) |
| ***C10G 67/04*** | (2006.01) |
| ***C10G 67/06*** | (2006.01) |
| ***C10G 67/14*** | (2006.01) |
| ***C10L 1/08*** | (2006.01) |
| ***C10G 53/14*** | (2006.01) |

(56) References Cited

U.S. PATENT DOCUMENTS

| | | | | |
|---|---|---|---|---|
| 2,697,682 | A | | 12/1954 | Porter |
| 2,834,717 | A | | 5/1958 | Shiah |
| 3,284,342 | A | | 11/1966 | Nathan |
| 3,341,448 | A | | 9/1967 | Ford |
| 3,497,005 | A | | 2/1970 | Pelopsky et al. |
| 3,565,793 | A | | 2/1971 | Herbstman |
| 3,595,778 | A | | 7/1971 | Smetana |
| 3,616,375 | A | | 10/1971 | Inoue |
| 3,719,589 | A | | 3/1973 | Herbstman |
| 3,816,301 | A | | 6/1974 | Sorgenti |
| 3,945,914 | A | | 3/1976 | Yoo |
| 4,391,608 | A | | 7/1983 | Dondelewski |
| 5,110,443 | A | | 5/1992 | Gregoli et al. |
| 5,547,563 | A | | 8/1996 | Stowe |
| 5,753,102 | A | | 5/1998 | Funakoshi et al. |
| 5,800,698 | A | | 9/1998 | Tejada et al. |
| 5,824,214 | A | | 10/1998 | Paul et al. |
| 5,910,440 | A | | 6/1999 | Grossman et al. |
| 5,948,242 | A | | 9/1999 | Ohsol et al. |
| 5,985,137 | A | | 11/1999 | Ohsol et al. |
| 6,059,962 | A | * | 5/2000 | Alexander et al. ..... 208/238 |
| 6,160,193 | A | | 12/2000 | Gore |
| 6,279,653 | B1 | | 8/2001 | Wegener et al. |
| 6,338,793 | B1 | | 1/2002 | Putman |
| 6,402,939 | B1 | | 6/2002 | Yen et al. |
| 6,402,940 | B1 | | 6/2002 | Rappas |
| 6,405,796 | B1 | | 6/2002 | Meyer et al. |
| 6,406,616 | B1 | | 6/2002 | Rappas et al. |
| 6,454,936 | B1 | | 9/2002 | Varadaraj |
| 6,500,219 | B1 | | 12/2002 | Gunnerman |
| 6,544,411 | B2 | | 4/2003 | Varadaraj |
| 6,555,009 | B2 | | 4/2003 | Varadaraj |
| 7,081,796 | B2 | | 7/2006 | Krone |
| 2002/0029997 | A1 | | 3/2002 | Rappas et al. |
| 2003/0014911 | A1 | | 1/2003 | Gunnerman |
| 2003/0019791 | A1 | | 1/2003 | Austin |
| 2003/0085156 | A1 | | 5/2003 | Schoonover |
| 2007/0227951 | A1 | * | 10/2007 | Thirugnanasampanthar et al. ..... 208/243 |
| 2011/0220550 | A1 | * | 9/2011 | Bourane et al. ..... 208/212 |

OTHER PUBLICATIONS

Hu, Rigourous Hydrotreater Simulation, PTQ, Spring 2002, p. 85-91.*

International Search Report re PCT/US 11/28988, mailed Jun. 1, 2011.

Hu, Michael C., Rigorous Hydrotreater Simulation, PTQ, Spring 2002, pp. 85-91.

Liotta, Frank J., Production of Ultra-Low Sulfur Fuels by Selective Hydroperoxide Oxidation, National Petrochemical & Refiners Association Annual Meeting, Mar. 23-25, 2003, pp. 1-9.

* cited by examiner

PROCESS FOR REMOVING SULFUR FROM HYDROCARBON STREAMS USING HYDROTREATMENT, FRACTIONATION AND OXIDATION

CROSS-REFERENCE TO RELATED APPLICATIONS

The present application claims priority to U.S. Provisional Patent Application Ser. No. 61/315,737, filed Mar. 19, 2010, entitled PROCESS FOR REMOVING SULFUR FROM HYDROCARBON STREAMS USING HYDROTREATMENT, FRACTIONATION AND OXIDATION, all of the teachings of which are incorporated herein by reference.

STATEMENT RE: FEDERALLY SPONSORED RESEARCH/DEVELOPMENT

Not Applicable

BACKGROUND

Removing sulfur bearing compounds from crude oil/refined organic fuels is an extremely important objective. In fact, it is being mandated that sulfur levels need to get to as close to zero as possible. Conventional methodology has been to utilize hydrodesulfurization to remove sulfur atoms from hydrocarbon molecules via the application of hydrogen gas under high heat and pressure to ultimately produce hydrogen sulfide gas, which then may be subsequently converted to elemental sulfur. However, hydrodesulfurization is very costly as a capital expenditure as the necessary equipment is expensive and the process consumes substantial energy, as well as requires the use of catalysts and a source of hydrogen. Moreover, hydrodesulfurization is only partially effective in removing sulfur from hydrocarbons and cannot remove certain types of sulfur material, especially sterically-hindered organic sulfur-bearing compounds such benzothiophene compounds, which include benzothiophene, dibenzothiophenes, napthothiophenes and their mono, di and trialkyalted derivatives. Indeed, this family of molecules is the most expensive to remove and requires more severe hydrotreater pressure and heat, as well as hydrogen. Indeed, it is well recognized that benzothiophene compounds are the species that require the real majority of the energy and expense (up to 90%) to remove from hydrocarbon streams.

Oxidative desulfurization, as an alternative to hydrodesulfurization, has been around for a long time as a method to try to address this concern. Exemplary of such processes include those disclosed in U.S. Pat. Nos. 1,972,102 and 3,505,210. Such processes essentially involve oxidizing the organic sulfur-bearing compound to a sulfone or sulfoxide through the use of an oxidizing agent, typically hydrogen peroxide, in an acidic, aqueous environment, and thereafter removing the oxidized sulfur species by a variety of techniques based on the change in the chemical properties due to the oxidation of the sulfur atom.

Although effective, such methodology has not been commercialized because of the reaction time it takes to oxidize the aforementioned secondary sulfur species that are sterically-hindered and not readily accessible to oxidation, especially when an entire stream must be treated, which in some applications is simply too much volume to practically treat and is cost prohibitive. To enhance and expedite the oxidation reaction, attempts have been made to apply other energy sources, such as heat, pressure, microwaves, ultrasound, etc., to enhance or bolster the oxidative reaction. Exemplary of such further advancements in oxidative desulfurization include the disclosures in Applicant's U.S. Pat. No. 7,081,196, entitled TREATMENT OF CRUDE OIL FRACTIONS, FOSSIL FUELS, AND PRODUCTS THEREOF WITH SONIC ENERGY, and U.S. Pat. No. 7,871,512, entitled TREATMENT OF CRUDE OIL FRACTIONS, FOSSIL FUELS, AND PRODUCTS THEREOF, the teachings of which are expressly incorporated herein by reference.

However, these oxidative-based sulfur removal applications can still be costly compared to hydrodesulfurization because the infrastructure to perform hydrodesulfurization is already in place and the results, despite being sub-optimal, are at least known, as well as what the operating costs will be to apply such industrial application. Moreover, while ultrasound-assisted oxidative desulfurization generally works, the cost to apply such technology to treat a whole, entire stream of a refined organic fuel (e.g., diesel), as well as and the cost and risk in using such technology as a new treatment for a whole refinery is daunting from an investment standpoint, and using such a technology to address the problem may not be a practical or cost effective way to remove difficult sulfur species from the refined product on a large scale.

The complications associated with removing sulfur from refined hydrocarbon fuels/fossil fuel fractions are also present in post-refining operations and create a separate need to remove sulfur species despite previous treatment with an initial sulfur removal process. More specifically, refined petroleum products that are transported by pipeline normally are pumped sequentially, as a continuous flow through the pipeline. As a result, some amount of mixing of adjacent product types normally occurs. The product in a pipeline between two adjacent volumes of petroleum product consists of a mixture of the two adjacent volumes and is called "interface." Generally, interface mixture is blended into the two adjoining products that created the interface. Transmix is an interface consisting of two adjacent dissimilar petroleum products, such as gasoline and distillate fuel, which cannot be blended into either of the two adjacent products without causing either of them to violate commercial standards.

Since the transmix cannot be blended into either of the two adjacent products transported by the pipeline, it is diverted by the pipeline into a separate storage tank. Transmix is generally transported via tank truck, pipeline or barge to a facility designed to separate the transmix into its fuel components. For example, where the transmix consists of gasoline and distillate fuel, the transmix may be transported to a "transmix processing" facility where the gasoline portion is separated from the distillate fuel. At locations where it is either relatively expensive or inconvenient to transport transmix to a transmix processing facility for separation, the transmix is sometimes blended into gasoline in very small amounts, typically around 0.25 volume percent of the gasoline.

Transmix processors and transmix blenders, however, are refiners under the Environmental Protection Agency (EPA) regulations. Historically, the EPA provided transmix processors and transmix blenders with flexibility in complying with refiner requirements. That flexibility, however, is nearly at end, requiring transmix processors and transmix blenders to comply with gasoline sulfur regulations under 40 CFR Part 80, subpart H. As a consequence, an entire, separate, post-refining industry is now faced with the same challenges as refiners, and now must implement measures to reduce the levels of sulfur to levels that comply with regulatory requirements which are becoming increasingly stringent.

Accordingly, there is a need in the art for processes that can facilitate the removal of sulfur from refined hydrocarbon streams, including difficult to remove sulfur species that are commercially practical, efficient and cost effective. There is likewise a need in the art for processes that can facilitate the removal of sulfur from refined hydrocarbon streams that can be readily deployed in existing refining facilities utilizing existing hydrodesulfurization infrastructure, yet need only require treatment of a small fraction of the hydrocarbon stream to remove problematic organic sulfur species. There is still further a need for processes that can facilitate the removal of sulfur from refined hydrocarbon streams that can be utilized in transmix operations to remove problematic organic sulfur species present in post-refined hydrocarbon streams.

BRIEF SUMMARY

The present invention specifically addresses and alleviates the above-identified deficiencies in the art. More specifically, the present invention is directed to processes for removing sulfur from hydrocarbon streams using a sequential application of hydrotreatment, fractionation and oxidation whereby substantially all sulfur species, including easily removed sulfur species such as sulfides and mercaptans, as well as difficult to remove organic sulfur compounds, including benzothiophene compounds, can be effectively and efficiently removed in a commercially cost-effective manner.

According to a preferred embodiment, there is provided a hydrocarbon stream, which may take any of a variety of hydrocarbon fractions derived from crude oil. Although applicable to all types of fractions, it is expressly contemplated that the processes disclosed herein are particularly well-suited for refinery distillates boiling higher than the naptha fraction (gasoline), including the gas oil fractions (diesel fuel products) that contain considerable amounts of sulfur compounds. With respect to such hydrocarbon stream from which sulfur is sought to be removed, such stream is initially subjected to conventional hydrodesulfurization. In this regard, and contrary to conventional practice, the hydrodesulfurization as applied pursuant to the present invention need only be applied at sufficient temperatures and pressures necessary to remove what is generally understood to be the more easily-removed sulfur species, such as sulfides, disulfides and mercaptans, such as utilized to produce low sulfur diesel having approximately 500 ppm sulfur compounds. Along these lines, the hydrotreatment processes referenced herein are not meant nor are contemplated to be applied in a manner sufficient to remove or otherwise treat the aforementioned sterically-hindered organic sulfur compounds (i.e., benzothiophenes, dibenzothiophenes, etc.). As a consequence, substantial savings are realized by reduced hydrodesulfurization operating costs, as well as hydrogen consumption and prolonged catalyst life, that would typically apply when utilizing hydrodesulfurization for example to produce ultra-low sulfur diesel having 15 ppm or less sulfur compounds.

Following initial hydrodesulfurization, the hydrocarbon stream is then fractionated through conventional practices via the use of a fractionation or distillation tower or unit whereby the hydrocarbon stream is fractionated into at least two sub-fractions or sub-streams, namely, a first sub-stream that contains substantially no organic sulfur species and a second sub-stream within which substantially all the sulfur species not previously removed by hydrodesulfurization are concentrated. In this regard, the fractionation step involves selectively heating the hydrocarbon stream at a target temperature range, typically between 560-719° F., that is commensurate with the boiling points of the specific sulfur species (e.g., dibenzothiophenes) surviving hydrodesulfurization, so that these sulfur species accumulate in the sub-fraction or sub-stream such that there is ultimately produced a sulfur-free sub-stream and a sulfur-rich sub-stream, the latter having substantially less volume than the hydrocarbon stream form which it was derived. To that end, ideally, the fractionation will thus be performed at a temperature that approximates the boiling point of the primary sulfur species concentrated in the sulfur-rich sub-stream.

With respect to the latter, the sulfur-rich sub-stream is then isolated and subjected to an oxidative process that is operative to cause a majority, if not substantially all of the sulfur species present to become oxidized to sulfones or a mixtures of sulfones and sulfoxides. To that end, an oxidant, such as hydrogen peroxide, is contacted with the sulfur-rich sub-stream to form a reaction mixture, the latter being subjected to an energy source, which may include ultrasound, in order to expedite and enhance the oxidative process. Advantageously, as opposed to treating the entire hydrocarbon stream, the processes discussed herein only require that a small portion of the starting hydrocarbon stream, which is approximately 10% to 33% by volume of the pre-fractionation hydrocarbon stream, is actually treated, which thus in turn enables the oxidation step to be performed on a much lower scale and requiring substantially less oxidant and ultrasonic energy as compared to prior art practices that apply oxidation to the entire hydrocarbon stream.

Following the oxidation step, the oxidized sulfur species may be removed in any of a variety of ways known in the art, such as through solvent extraction, solid bed absorption, cold filtration or even further hydrodesulfurization to thus ultimately produce a desulfurized hydrocarbon stream. The oxidized stream may also be re-fractionated per the above process to thus further isolate and oxidize any sulfur species present. In some embodiments, it is even contemplated that the oxidation process may be deployed prior to the hydrodesulfurization step in order to pre-treat or oxidize the sulfur species to help expedite and facilitate the hydrodesulfurization reaction.

In an alternative embodiment, which is particularly well suited for transmix operations, the processes as disclosed herein are directed to providing a high sulfur-content hydrocarbon stream that may either be a high sulfur whereby a generally sulfur-free sub-stream and a sulfur-rich sub-stream are generated. The sulfur-contaminated hydrocarbon stream is subjected to an oxidative process whereby the majority, if not substantially all of the sulfur present is oxidized sulfones/sulfoxides with the oxidized sulfur subsequently being removed in a sulfur removal step, which may comprise solid bed absorption. Such process is ideally suited for transmix applications where hydrodesulfurization cannot be applied or is impractical to implement.

Advantageously, the processes disclosed herein can make use of existing hydrodesulfurization infrastructure while not requiring operation of such processes at levels that require substantial energy and hydrogen use, but rather at lower temperatures and pressures commonly associated with producing low sulfur diesel (500 ppm) as opposed to ultra-low sulfur diesel (15 ppm), thus providing a substantial cost savings. Moreover, because the fractionation step utilizes a selectively targeted temperature that produces a hydrocarbon sub-stream that concentrates the sulfur species, a substantially lesser volume need be treated via the oxidation step which thus makes the oxidative application far more commercially feasible than prior art oxidative desulfurization processes requiring treatment of the entire hydrocarbon stream. Still further, the sulfur removal process that removes oxidized sulfur species may take any of a variety of conventional forms well-known in the art and can be readily implemented using existing refining technology.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The present invention is directed to methods for removing problematic organic sulfur species from a hydrocarbon stream that have been devised to work on just focusing on the specific types of difficult to remove sulfur species, benzothiophene compounds, and in particular to separating those species and treating them. The substantial advantages include lower the capital expenditures and ongoing cost without the fear or concerns of having to adopt an entirely new technology (as opposed to conventional hydrodesulfurization) to remove problem sulfur species. The invention also addresses this problem in a manner that is far more efficient and creates substantially less pollution that convention practices.

Generally, the processes herein involve providing a refined hydrocarbon stream (e.g., diesel) known to have a high sulfur content and initially subjecting the stream to hydrodesulfurization. Following the hydrodesulfurization step, the stream is fractionated to produce a separate sub-stream containing the organic sulfur from the remaining stream to produce a sulfur-concentrate or sulfur-rich organic component so that little volume is being treated in a subsequent oxidation step, as compared to the entire stream. That is, the stream on an atmospheric tower will cause the sulfur species to separate from the stream, typically in the range from about 560-719° F. As a result, most of benzothiophene compounds found in diesel, including dibenzothiophenes or napthothiophenes are concentrated and can be treated as a small subsection of the diesel or other hydrocarbon stream. This resultant high sulfur content sub-stream is then subjected to an oxidative process (i.e., an oxidizing agent provided in a sufficient quantity to oxidize all or the majority of sulfur present), preferably ultrasound assisted, which preferably can be conducted at substantially reduced volumes compared to treating an entire stream. It is likewise contemplated that the process could be performed without having to use aqueous emulsions, which could omit the use of water, phase transfer agents (PTA) or surfactants, or both and with fewer ultrasound probes. The resultant stream could be treated to remove the oxidized sulfur or could also be fractionated again in which case the boiling point post oxidation (due to the presence of sulfones) would be higher and likely out of the diesel range. Alternatively, the post-oxidized sub-stream can be re-directed into the hydrotreater where the post-oxidized sulfur is now more easily removed.

Figure 1:
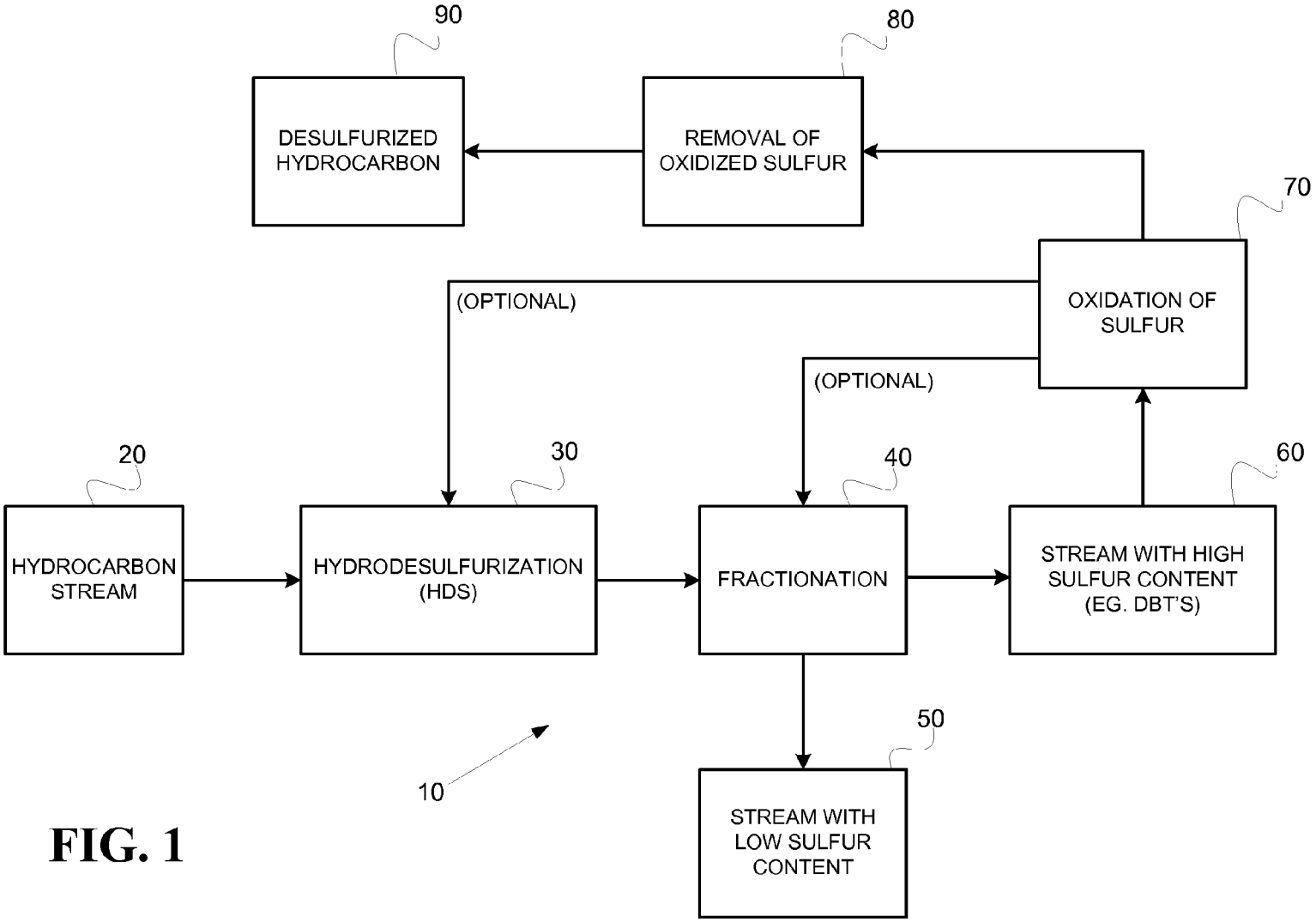
FIG. 1 is a schematic diagram illustrating the steps and sequence for removing sulfur from a hydrocarbon stream using the combined application of hydrodesulfurization, fractionation, and oxidation according to a preferred embodiment of the present invention.

The figures describe the sequence of steps to perform the processes as envisioned. Referring firstly to FIG. 1, there is shown a schematic diagram illustrating the process 10 for removing sulfur compounds from a hydrocarbon stream according to a preferred embodiment of the present invention. The process shown is particularly effective in removing all types of sulfur species, including difficult to remove benzothiophene compounds, including benzothiophene, dibenzothiophene, napthobiophene, mono, di and tri-alkylated derivatives. The process is suited to facilitate the removal of such compounds from any of a variety of hydrocarbon streams derived from fractions of crude oil, and in some application may be used to treat crude oil itself. Notwithstanding, the processes as described herein are particularly well-suited for application to refinery distillates boiling higher than the naptha fraction, including the gas oil fractions, which include diesel.

The process 10 begins by providing such hydrocarbon stream 20, which will be contaminated with a variety of sulfur compounds well-known to those skilled in the art including a mixture of sulfides, disulfides, mercaptans and the benzothiophene compounds discussed above. Typically, it is contemplated that the hydrocarbon stream may have anywhere from 50 to 2000 ppm of the sulfur compounds, and most likely in the range of 300-500 ppm sulfur compounds, which in any event higher than the 15 ppm target which the processes of the present invention are designed to attain, if not lower levels such as 10 ppm, 5 ppm or less. The hydrocarbon stream is first subjected to hydrodesulfurization step 30, which may take any of a variety of conventional applications that deploy hydrogen gas at elevated temperatures and pressure to convert at least a portion of the sulfur compounds to hydrogen sulfide gas, the latter of which can likewise be removed through conventional processes. Along those lines, it is contemplated that the hydrodesulfurization step 30 will be operative to remove those sulfur compounds that are recognized as being easily removed via hydrodesulfurization, including sulfides, disulfides and mercaptans, as deployed for example to produce low sulfur diesel fuel.

Indeed, it is expressly contemplated that the hydrodesulfurization step 30 would at best be partially effective at removing the sterically-hindered sulfur compounds, including the benzothiophene compounds discussed above as it is not contemplated that the hydrodesulfurization step 30 accomplish anything more than facilitate the removal of a portion of the recognized easy-to-remove sulfur species (i.e., the sulfur species that are not sterically-hindered).

To that end, it is believed the hydrodesulfurization step 30 need only be operated in a manner that is operative to reduce the sulfur content to approximately 50-500 ppm per the refiner's specific needs, as opposed to full severity hydrodesulfurization targeting removal of sulfur species down to approximately 5-7 ppm. By operating the hydrodesulfurization step 30 under such less severe conditions it is believed to result in a savings of approximately 45% of hydrogen usage and 50% of catalyst life, not to mention substantial energy savings. Moreover, the processes of the present invention can be used in refineries with low severity hydrodesulfurization units making low sulfur diesel (LSD), which is 500 ppm or less by definition, to ultra-low sulfur diesel (ULSD), which by definition is less than 15 ppm, without a very expensive hydrodesulfurization equipment upgrade.

Following hydrodesulfurization 30, the hydrocarbon stream is then subjected to a fractionation process 40. The fractionation step 40 is likewise performed via conventional means, typically through the use of a fractionation or distillation tower whereby a hydrocarbon stream is heated at a select temperature range that is operative to generate at least two sub-streams from the original hydrocarbon stream 20. More specifically, the fractionation step 40 will apply a temperature range that is operative to produce a first hydrocarbon sub-stream 50 with a low sulfur content and a second sub-stream 60 with a high sulfur content. In this regard, the fractionation step 40 will expressly deploy heat in a temperature range corresponding to the boiling point range of the sulfur compounds remaining in the post-hydrodesulfurized hydrocarbon stream. To accomplish that end, it is contemplated that the sulfur species remaining in the hydrocarbon stream 20 following the hydrodesulfurization step 30 can be readily identified and the known corresponding boiling point or boiling points of the identified specie or species will be readily ascertainable and thus applied in the fractionation process 40. Along those lines, it is well-known the boiling points for most, if not all, of the benzothiophene compounds which will most likely be present in the hydrocarbon stream undergoing fractionation in step 40 will range from 560° F. to 719° F. and thus the fractionation step 40 may be operated within that temperature range, or more particularly a precise temperature range between 560° F. and 719° F., which will thus cause the target sulfur species, namely, one or more of the benzothiophene compounds, to accumulate in that portion of the hydrocarbon stream having a commensurate boiling point range. In this respect, by selectively targeting the boiling point range of the target sulfur species, the sub-stream of high-sulfur content 60 will actually cause the target sulfur species to accumulate and concentrate therein. Based upon available data, it is contemplated that operating the fractionation step 40 with a temperature range from 560° F. to 640° F. is ideal, and 580-600° F. being more highly preferred, for targeting dibenzothiophene. The temperature range of 650° F. to 719° F., and typically up to 700° F., is an optimal temperature range for performing the fractionation step 40 in refinery operations where substantially all species of benzothiophenes would be "picked up" and captured in the sulfur-rich sub-stream. Other specific temperature ranges can be readily identified that correspond to specific sulfur species sought to be targeted and ultimately isolated.

As a result of the fractionation step 40, the stream with low sulfur content 50 will be isolated and will posses 15 ppm sulfur compounds or less, and may reach levels of 10 ppm, 5 ppm or even lower. Such hydrocarbon stream 50 may thus be utilized as a fuel having met the lower sulfur concentration objective. It is contemplated that the sub-stream with low sulfur content 50 will make up approximately 67% to 90% of the volume of the starting hydrocarbon stream 20 following the fractionation step 40, whereas the hydrocarbon sub-stream with high sulfur content 60 will make up the remaining 10% to 33% of the volume of the starting hydrocarbon stream 20.

Advantageously, the fractionation step 40 not only produces a significant hydrocarbon sub-stream that is low in sulfur content, such fractionation in step 40 further produces a hydrocarbon sub-stream to be subsequently treated via oxidation, discussed more fully below, that has substantially reduced volume (i.e., 10%-33% of starting hydrocarbon stream 20) and concentrates the remaining portion of sulfur species not previously removed by hydrodesulfurization 30, which thus allows for tremendous efficiencies that have not heretofore been available. Likewise, the deployment of the fractionation step 40 in order to generate select hydrocarbon streams for targeted isolation and treatment could be deployed in combination with other refinery processes, such as the targeted isolation and treatment of sulfur species from the output of atmospheric and vacuum towers whereby typical atmospheric fractional distillation towers may be modified with an additional tray to generate a target sub-stream, as may occur with straight run diesel prior to hydrotreatment. In all case, however, the fractionation step is primarily deployed to generate a low volume sub-stream where a specific sulfur species is targeted and sought to be concentrated.

In this regard, the hydrocarbon sub-stream with high sulfur content 60 is generated to allow for more efficient sulfur removal. To that end, the hydrocarbon sub-stream with high sulfur content 60 is subjected to an oxidation process 70, which is operative to selectively oxidize the sulfur molecules present in the organic sulfur compounds present in the hydrocarbon sub-stream 60. The oxidation step 70 may take any of a variety of oxidation processes known in the art that are operative to convert the sulfur-bearing compounds to sulfones, sulfoxides or mixtures thereof. In this regard, such oxidation processes 70 may deploy an oxidizing agent, such as peroxides, peracids and the like that are mixed with the stream with high sulfur content 60 such that the oxidant is allowed to react with the sulfur molecules to thus facilitate the desired formation of sulfones and/or sulfoxides. It is expressly contemplated that the oxidizing agent may be hydrogen peroxide and further, that the oxidation of sulfur performed at step 70 may be facilitated via the application of an energy source, such as heat, microwaves, sonic energy or the like to thus enhance the oxidation reaction. Along those lines, it is expressly contemplated that Applicant's ultrasound-enhanced oxidative processes disclosed in U.S. Pat. Nos. 7,081,196 and 7,871,512 be practiced at the oxidation step 70.

As has been discovered as being particularly effective, the oxidation step 70 when utilized to treat diesel, hydrogen peroxide is deemed to be a preferred oxidant that is added in an amount ranging from 2-3% $H_2O_2$ (by volume) to diesel. In a more highly preferred embodiment, hydrogen peroxide is provided in an amount of approximately 2.5% by volume of diesel being treated. Along those lines, there was no evidence that large excesses of $H_2O_2$ were beneficial in improving the final level of desulfurization. The calculated stoichiometric amount of 30 wt % $H_2O_2$ required to react with a 46 ml sample of low sulfur diesel (LSD) with 232 ppmw sulfur to form all sulfones (2 atoms of oxygen/atom of sulfur) was 0.0294 ml. Therefore, each 1 ml of $H_2O_2$ provides about 34 times the stoichiometric requirement for oxidation. Because hydrogen peroxide is a commodity, the same is commercially available and provided by multiple suppliers. One preferred supplier includes U.S. Peroxide base in Atlanta, Ga.

With respect to the application of ultrasound to facilitate and enhance to oxidative reaction, it is believed that conventional, commercially-available ultrasound probes may be deployed and utilized per the teachings of Applicant's aforementioned patents. Based upon testing performed by Applicant, the preferred energy required for processing is approximately 1 kW min/liter of hydrocarbon, which translates to 120 kW and can be accomplished in a 20-foot container discussed further in relation to FIG. 2.

Among the commercially-available probes suitable for the practice of the present invention include those ultrasound probes produced by Hielsher based in Teltow, Germany. Advantageously, Hielsher probes are self regulated with an automatic scanning design that automatically adjusts for fluctuations in feed stock characteristics based on composition, viscosity and pressure. Depending on the specific application, and in particular the volume of the stream subjected to the oxidation process, there is set forth in Table 1 below the ultrasound power required to treat a given volume stream as may be based upon the size of the facility deploying the same.

TABLE

| SIZE | VOLUME STREAM | POWER |
|---|---|---|
| Pilot Plant Small | 16 liters/min | 16 kW |
| Pilot Plant Medium | 48 liters/min | 48 kW |
| Pilot Plant Large | 112 liters/min | 128 kW |
| Process Demo Unit | 567 liters/min | 640 kW |
| Commercial Production | 5568 liters/min | 6336 kW |

Following the oxidation step 70, the resultant hydrocarbon stream may be further processed at step 80 whereby the oxidized sulfur species, present as sulfones and/or sulfoxides, will be removed. To that end, the removal of the oxidized sulfur in step 80 may take any of a variety of forms well-known in the art, including solvent extraction, cold filtration or solid bed absorption. With respect to the latter, it is contemplated that oxidized sulfur species may be readily removed via passing the hydrocarbon stream through an absorption tower having an absorbent contained therein.

Exemplary of such absorption towers include those solid absorber systems to remove sulfones produced by PSB Industries Inc. of Erie, Pa. An ideal absorbent used as part of such absorber system includes Selexsorb CD, and alumina-based absorbent produced by BASF of Edison, N.J.

PSB, Inc. manufactures custom dehydration and purification systems meeting specific customer requirements and, as an exemplary application in the processes disclosed herein, PSB, Inc.'s type "E" closed-loop regenerative unit utilizing a semi-closed loop cycle to remove contaminants from the desk and bed is particularly well-suited. Such system is designed to handle the following specifications.

Inlet Flow: 2,500 bbls/day

Inlet Pressure: 60 psig

Inlet Temperature: 100° F.

Inlet Contaminants: 150 ppmw Sulfones

Exit Specification: <15 ppmw Sulfones

Following the removal of the oxidized sulfones at step 80, there is thus produced desulfurized hydrocarbon stream 90, which will possess 15 ppm sulfur species or less, and more practically either 10 ppm, 5 ppm or less. Such desulfurized hydrocarbon 90 will thus attain the level of sulfur content that is desired and hence will comply with regulatory standards.

As an alternative to removing the oxidized sulfur species in step 80 to produce a desulfurized hydrocarbon stream at step 90, the hydrocarbon stream subjected to the oxidation step 70 may optionally be diverted back to either the hydrodesulfurization step 30, in case the stream, after having been subjected to the oxidation process 70, still contains an unacceptably higher levels of sulfur species, either by incomplete removal via hydrodesulfurization and/or suboptimal oxidation. In this regard, the hydrocarbon stream need only be reintroduced to the hydrodesulfurization process 30 whereby the hydrodesulfurization step 30 and fractionation step 40 will be repeated as discussed above. Along those lines, it is contemplated that feeding the post-oxidation hydrocarbon stream performed at step 70 to hydrodesulfurization step 30 will be preferred to the extent the sulfur species remaining following the oxidation step 70 comprise sulfur species that are more easily and effectively removed by hydrodesulfurization, such as the disulfides and mercaptans discussed above, and/or are present as sulfones, which are likewise easier to remove by hydrodesulfurization. In fact, in an alternative embodiment, it is contemplated that the oxidation step may be performed prior to the hydrodesulfurization step in order to oxidize the sulfur compounds beforehand, which is known to facilitate and expedite the hydrodesulfurization reaction, which as a consequence can lead to less hydrodesulfurization reaction times and help reduce or eliminate "bottlenecking" or the backlog in hydrodesulfurization processing of hydrocarbon streams as is common in the refining industry.

Alternatively, to the extent the hydrocarbon stream following the oxidation step 70 contains primarily the sterically-hindered sulfur species, namely, the benzothiophene compounds, such hydrocarbon stream may be fed from oxidation step 70 back to the fractionation step 40 whereby the fractionation step 40 is repeated per above. In this regard, to the extent it is contemplated that the sulfur species remaining in the hydrocarbon stream following the oxidation step 70 will not likely be removed by hydrodesulfurization, repeating the fractionation step 40 will be ideal so as to conserve hydrodesulfurization resources that would not be expected to effectuate any further significant removal of the sulfur compounds present in the hydrocarbon stream.

Figure 2:
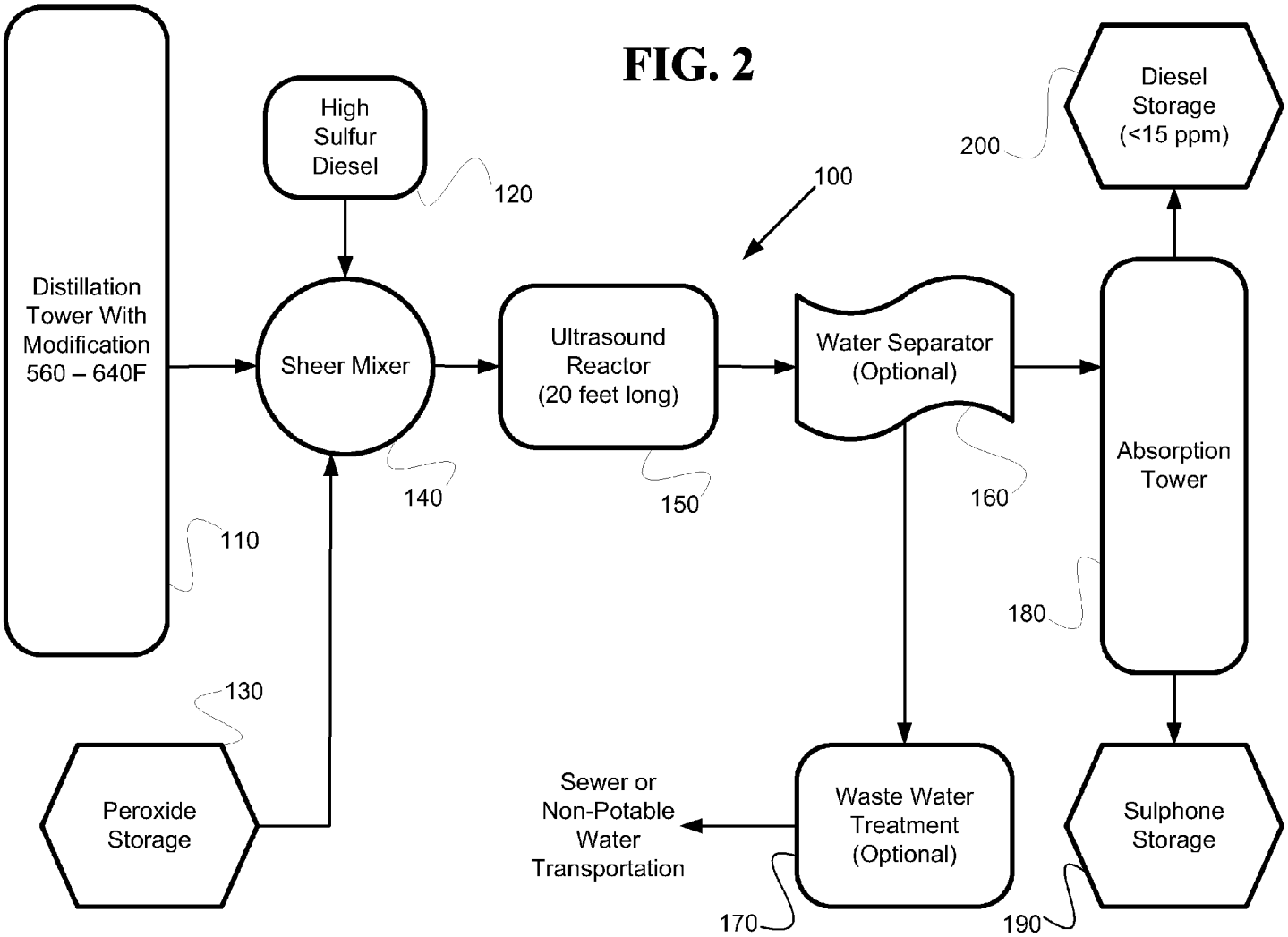
FIG. 2 is a schematic diagram illustrating a modified process for removing sulfur from a hydrocarbon stream and/or diesel, using the combined application of fractionation (optional), oxidation and absorption according to a preferred embodiment of the present invention.

Referring now to FIG. 2, there is schematically illustrated an alternative process 100 operative to effectuate the removal of sulfur compounds from refined hydrocarbon streams that are particularly effective for use in transmix operations or in other situations where hydrodesulfurization is not available or impractical to deploy. According to such process 100, there is provided a hydrocarbon stream having a high sulfur content, such as high sulfur diesel 120. Alternatively or in addition to the hydrocarbon stream having a high sulfur content, there may be provided a fractionation or distillation tower 110 that, per step 40 discussed above in FIG. 1, may be operative to selectively generate a hydrocarbon sub-stream having a high sulfur content of a target sulfur species. In this regard, it is contemplated that the fractionation step performed by distillation tower 110, may be selectively operated at a target temperature range that will be operative to produce a hydrocarbon stream that will specifically target one or more benzothiophene compounds having a boiling point range that coincides with the targeted temperature range at which the distillation tower is operated.

In either case, the high sulfur content hydrocarbon stream, whether fed from distillation tower 110 or provided from an external source such as 120, is added to a sheer mixer 140 to which is added an oxidizing agent. In the embodiment shown, an oxidizing agent comprises a peroxide (i.e., hydrogen peroxide) fed from a peroxide storage unit 130, which would be operative to feed the peroxide oxidant in amounts relative the hydrocarbon stream fed to the sheer mixer in the amounts discussed above so that the majority, if not substantially all of the sulfur species may be converted to sulfones and/or sulfoxides.

Once mixed in the sheer mixer, the hydrocarbon stream with oxidizing agent is subjected to an energy source to facilitate and enhance the oxidation of the sulfur species. In the embodiment shown, such reaction mixture is fed to an ultrasound reactor which applies ultrasound at energy levels sufficient to facilitate substantial, if not complete, oxidation of the sulfur species per the processes discussed above. A 20 foot long reactor using Hielscher ultrasound probes operative to deliver the desired energy per volume of hydrocarbon stream being treated is a preferred design.

Based upon the volumes and concentration of the peroxide fed to the sheer mixer 140, and particularly whether or not the reaction mixture subjected to ultrasound at step 150 contains an aqueous phase, the reaction mixture after having been subjected to ultrasound at step 150 may go through an optional water separation step 160. In the preferred embodiment, it is contemplated that the oxidant, namely, hydrogen peroxide, mixed with the high sulfur content hydrocarbon stream will not produce an aqueous phase and that only limited amounts of hydrogen peroxide will be added to thus conserve the hydrogen peroxide and thus eliminate water separation step 160. Nevertheless, to the extent such water separation step 160 is performed, it is contemplated that the isolated water aqueous phase will be treated at step 170 through conventional practices and thereafter disposed of through conventional and/or municipal disposal means.

The remaining hydrocarbon stream will be treated to remove the oxidized sulfur species, which may comprise any of a variety of steps known as discussed above. In the illustrated embodiment, the oxidized sulfur may be removed via solid bed absorption whereby the hydrocarbon stream is fed to an absorption tower 180 that includes a suitable absorbent as such alumina-based Selexsorb CD. As a consequence, the absorption tower 180 will thus be operative to isolate sulfones and sulfoxides, which will then be transferred to a sulfone storage facility 190 and the resultant hydrocarbon stream isolated and stored, such as the diesel storage reference as 200 in FIG. 2. Such hydrocarbon stream will possess a sulfur content of less than 15 ppm, and preferably lower levels such as 10 ppm, 5 ppm or less.

Advantageously, the processes herein provide substantial cost savings. One, no phase transfer agent (PTA) is required and further no water need be added so there is no need for dirty emulsification with oil/water to clean. In this regard, there are no emulsifiers to interfere with the oxidative reaction as ultrasound has severe pressures and temps that push the reaction. Ultrasound (or a shear mixer before reaction) makes the interface of the oxidizing agent (e.g., peroxide) and oil so small the reaction is most efficient.

Two, whenever possible, the organic sulfur is separated from the stream as a concentrate so that little volume is being treated by oxidative desulfurization, as compared to the entire stream. Along those lines, if the stream is fractionated at the atmospheric tower to target only the dibenzothiophenes, and only that portion containing the dibenzothiophenes is treated, the equipment and process costs are significantly less as it is primarily this stream that contains the sulfur species that is most difficult to treat by hydrodesulfurization. Less capital cost, less operating cost, less separation cost (i.e., on the atmospheric tower, the fractionation processes separate at about 650-719° F. most of dibenzothiophenes, which are then treated as a small subsection of the diesel). Moreover, as discussed above, the sub-stream could be fractionated again, with the boiling point post-oxidation consequently being higher and now out of the diesel range. In this regard, the oxidized sulfur will take the form of a sulfone that boils at approximately 100-150° F. higher. This separated, concentrated stream could then be treated to remove the oxidized sulfur via conventional means (e.g., solvent extraction and the like) or alternatively, could be returned to the hydrodesulfurization unit to thus more easily remove the oxidized sulfur via hydrodesulfurization. In any event, instead of tens of millions in capital expenditures, it is estimated the aforementioned methodology could be implemented for a few million dollars in capital cost, along with a huge savings on hydrodesulfurization operation.

The above description is given by way of example, and not limitation. Given the above disclosure, one skilled in the art could devise variations that are within the scope and spirit of the invention disclosed herein, including various ways of removing problematic organic sulfur species from refined hydrocarbon streams the rely upon a sequential application of hydrotreatment, fractionation, and oxidation processes to selectively target, concentrate and oxidize problematic organic sulfur species and thereafter remove the same. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method for removing sulfur compounds from a hydrocarbon stream comprising the steps:

a) providing a hydrocarbon stream having sulfur compounds therein;

b) oxidizing said sulfur compounds in said hydrocarbon stream;

c) hydrotreating said hydrocarbon stream oxidized in step b) to convert a portion of said sulfur compounds to hydrogen sulfide and removing said hydrogen sulfide;

d) fractionating said hydrocarbon stream hydrotreated in step c) via fractional distillation to generate a first hydrocarbon sub-stream having substantially all sulfur compounds removed therefrom and a second hydrocarbon sub-stream having substantially all remaining sulfur compounds not removed via hydrotreatment;

e) reintroducing said second hydrocarbon sub-stream into the hydrocarbon stream of step a).

2. The method of claim 1 wherein said hydrocarbon stream is diesel fuel.

3. The method of claim 2 wherein in step d), said fractionation step is performed in a distillation tower at a temperature range corresponding to the boiling points of said remaining sulfur compounds remaining in said second hydrocarbon sub-stream not removed via hydrotreatment in step c).

4. The method of claim 2 wherein in step d), said fractionation step is performed in a distillation tower at a temperature range between 560-719° F.

5. The method of claim 4 wherein in step d), said fractionation step is performed at a temperature range between 560-640° F.

6. The method of claim 4 wherein in step d), said fractionation step is performed at a temperature range between 650-719° F.

7. The method of claim 1 wherein said sulfur compounds converted to and removed as hydrogen sulfide in step c) comprise sulfur compounds selected from the group consisting of sulfides, disulfides and mercaptans and said sulfur compounds oxidized in step b) comprise sulfur compounds selected from the group consisting of benzothiophenes, dibenzothiophenes and napthaothiophenes and alkyalted derivatives thereof.

8. The method of claim 2 wherein said sulfur compounds oxidized in step b) are oxidized via an oxidant in combination with the application of ultrasound.

9. The method of claim 8 wherein said oxidant is hydrogen peroxide.

10. The method of claim 8 wherein said hydrogen peroxide is present in an amount of 2-3% by volume of diesel and said ultrasound is applied at a power of at least 1 kW min per liter of diesel.

* * * * *